US006655143B2

(12) United States Patent
Daunas

(10) Patent No.: US 6,655,143 B2
(45) Date of Patent: Dec. 2, 2003

(54) AUTONOMOUS GAS POWERED RAM

(76) Inventor: Yves Daunas, Les Bruyères Le Briou, 45240 Menestreau en Villette (FR)

( * ) Notice: Subject to any disclaimer, the term of this patent is extended or adjusted under 35 U.S.C. 154(b) by 0 days.

(21) Appl. No.: 09/978,675

(22) Filed: Oct. 18, 2001

(65) Prior Publication Data

US 2003/0033804 A1 Feb. 20, 2003

(30) Foreign Application Priority Data

Aug. 17, 2001 (CA) ..... 2355504

(51) Int. Cl.[7] ..... F01B 29/08
(52) U.S. Cl. ..... 60/635; 60/632
(58) Field of Search ..... 60/632, 635

(56) References Cited

U.S. PATENT DOCUMENTS

| | | | | |
|---|---|---|---|---|
| 2,639,913 A | | 5/1953 | Reynolds | |
| 3,010,752 A | | 11/1961 | Geffner | |
| 3,118,349 A | | 1/1964 | Combs | |
| 3,199,288 A | | 8/1965 | Nahas | |
| 3,762,514 A | | 10/1973 | Freitag | |
| 3,888,085 A | * | 6/1975 | Larsonneur | 244/122 R |
| 3,915,242 A | * | 10/1975 | Bell | 173/206 |
| 4,091,621 A | * | 5/1978 | Patrichi | 60/635 |
| 4,237,690 A | | 12/1980 | Tsuge et al. | |
| 4,412,420 A | * | 11/1983 | Patrichi et al. | 60/635 |
| 4,860,698 A | * | 8/1989 | Patrichi et al. | 123/24 R |
| 4,945,730 A | * | 8/1990 | Laney | 227/10 |
| 5,454,622 A | | 10/1995 | Demopoulos | |
| 5,538,172 A | * | 7/1996 | Jochum et al. | 173/212 |
| 5,791,597 A | | 8/1998 | Knoll | |
| 6,109,689 A | | 8/2000 | Nanni | |
| 6,113,185 A | | 9/2000 | Yamaguchi et al. | |

FOREIGN PATENT DOCUMENTS

| | | |
|---|---|---|
| DE | 37 27 666 A1 | 3/1989 |
| JP | 55-152903 | 11/1980 |

* cited by examiner

*Primary Examiner*—Hoang Nguyen
(74) *Attorney, Agent, or Firm*—Burns, Doane, Swecker & Mathis, L.L.P.

(57) ABSTRACT

An autonomous gas powered ram comprising a main body having an internal cavity and an actuator mounted in this internal cavity. The actuator is movable in the cavity from a first operative mode to a second operative mode. Movement of the actuator towards the second operative mode is caused by the detonation of an explosive charge located within the cavity. The explosive charge is detonated upon detection of an operation failure, a fire or a hazardous operation condition. The ram also comprises a lock for preventing the actuator from moving to the first operative mode once the explosive charge has detonated.

19 Claims, 6 Drawing Sheets

AUTONOMOUS GAS POWERED RAM

FIELD OF THE INVENTION

The present invention relates to an autonomous gas powered ram comprising an actuator that is movable from a first operative mode to a second operative mode, movement of the actuator towards the second operative mode is caused by the detonation of an explosive charge located within the ram.

BACKGROUND OF THE INVENTION

In many mechanical systems, it is often necessary to provide an actuator that can be used to activate a certain component or functions when an emergency arises. One specific example is to bring an elevator car to a stop. Current available technologies accomplish this task by using electrically, hydraulically or pneumatically powered sources. This approach is unsatisfactory because of the inherent complexity of the systems using these types of powered sources which reduces their reliability. Accordingly, there is a need in the industry to provide a novel device that can be used to provide or perform an emergency function and which is simple and more reliable than prior art systems.

SUMMARY OF THE INVENTION

As embodied and broadly described herein, the invention seeks to provide an autonomous gas powered ram, comprising: a main body having an internal cavity; an actuator mounted in said internal cavity, said actuator being movable in said cavity from a first operative mode to a second operative mode, in said first operative mode said actuator being in a first position relative to said main body, in said second operative mode said actuator being in a second position relative to said main body, said first position being different from said second position; an explosive charge located within said internal cavity, a detonation of said charge causing movement of said actuator towards said second operative mode; and a lock in said main body for preventing said actuator from moving to said first operative mode when said explosive charge has detonated.

As embodied and broadly described herein, the invention further seeks to provide a ram, comprising: a main body having an internal cavity; a piston slidingly mounted in said internal cavity and capable of movement therein; an actuator mounted in said main body, said piston being coupled to said actuator in a driving relationship, whereby movement of said piston in said internal cavity causes displacement of said actuator with relation to said main body; a fluid-pathway opening in said internal cavity for admitting pressurized working fluid to act on said piston to move said piston and displace said actuator; and an explosive charge located within said internal cavity, a detonation of said charge causing displacement of said actuator relative to said main body.

Preferably, the ram further comprises a piston capable of movement in the internal cavity, the actuator being connected to this piston whereby movement of the piston causes displacement of the actuator between the operative modes. The piston comprises a detonation chamber wherein the explosive charge is located. The ram also comprises an electric impulse pathway leading from the explosive charge to a sensor that is capable of detecting an operation failure. Upon detection of the operation failure, the explosive charge is triggered and the actuator is thus pushed in response to generation of the gas and move towards the second operative mode.

Most preferably, the piston is a first piston and the ram comprises a second piston mounted in the detonation chamber, the lock being mounted to this second piston. In fact, the second piston comprises latch members that prevent the actuator from moving to the first operative mode when the explosive charge has detonated. The lock mounted on the second piston is moveable along a first path of travel and the actuator connected to the first piston is moveable along a second path of travel, the first and the second paths of travel being parallel. The ram may include fluid-path openings for admitting pressurized working fluid to act on the piston.

Alternatively, the ram comprises a lock being movable in the internal cavity along a first path of travel, the actuator being movable along a second path of travel, these paths of travel being perpendicular. In this variant, the actuator comprises a portion having a pointed piercing end.

BRIEF DESCRIPTION OF THE DRAWINGS

A detailed description of the preferred embodiment of the invention is provided herein with reference to the following drawings, wherein.

Figure 1:
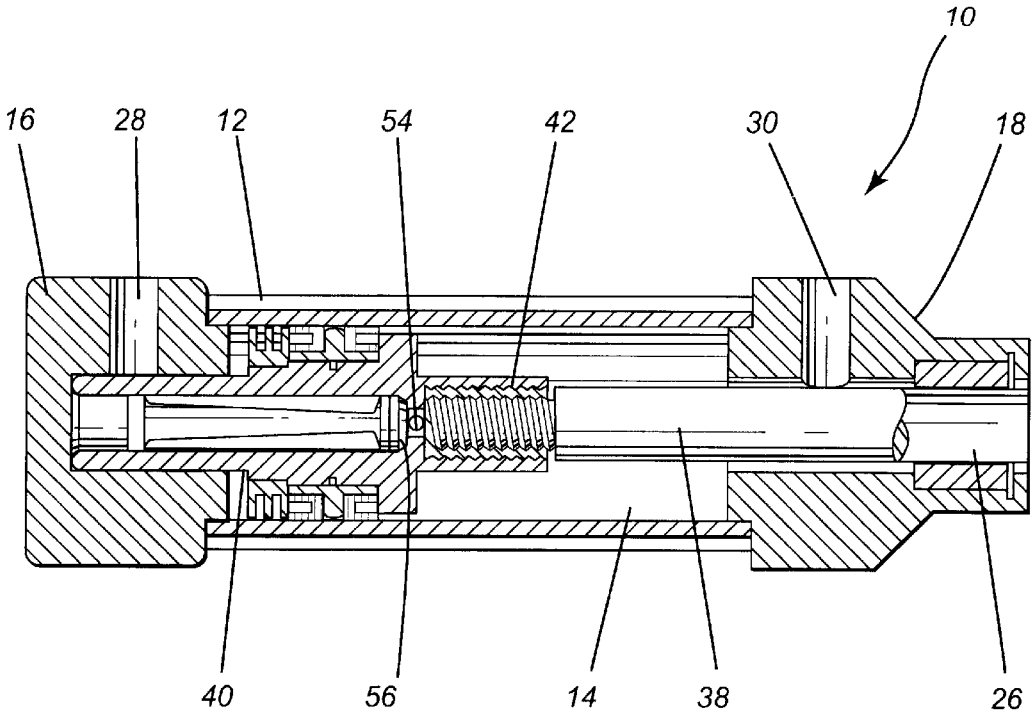
FIG. 1 is a cross sectional view of an autonomous gas powered ram constructed in accordance with a first embodiment of the invention comprising an actuator connected to a piston.

In the drawings, preferred embodiments of the invention are illustrated by way of examples. It is to be expressly understood that the description and drawings are only for the purpose of illustration and are an aid for understanding. They are not intended to be a definition of the limits of the invention.

DETAILED DESCRIPTION OF THE PREFERRED EMBODIMENTS

Figure 2:
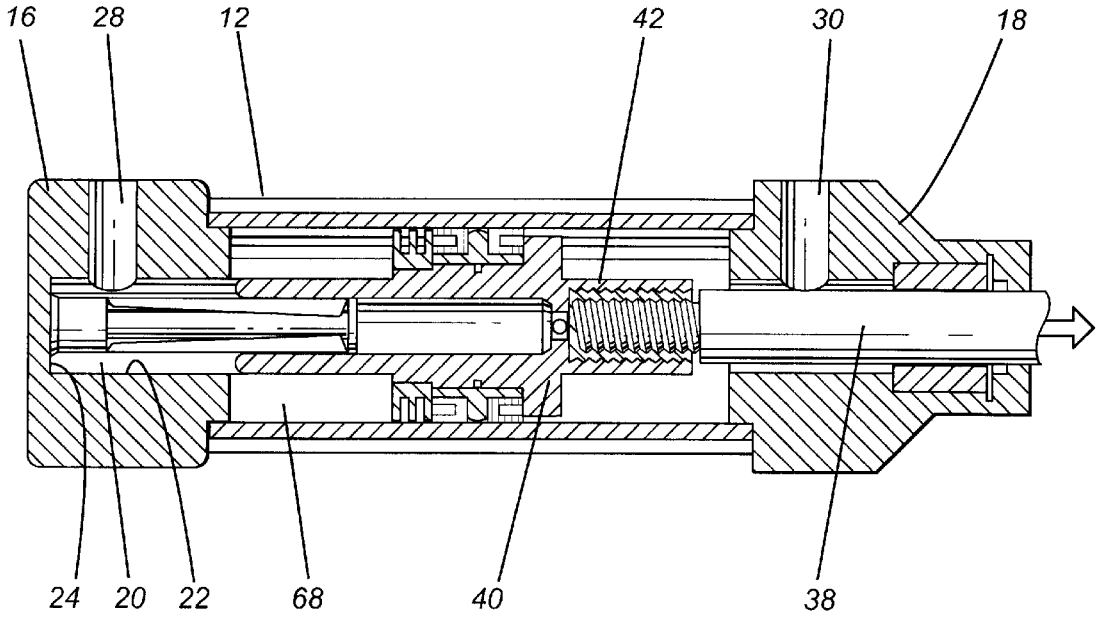
FIG. 2 is a cross sectional view of the autonomous gas powered ram of FIG. 2 wherein the actuator is illustrated during its movement towards a second operative mode.
Figure 3:
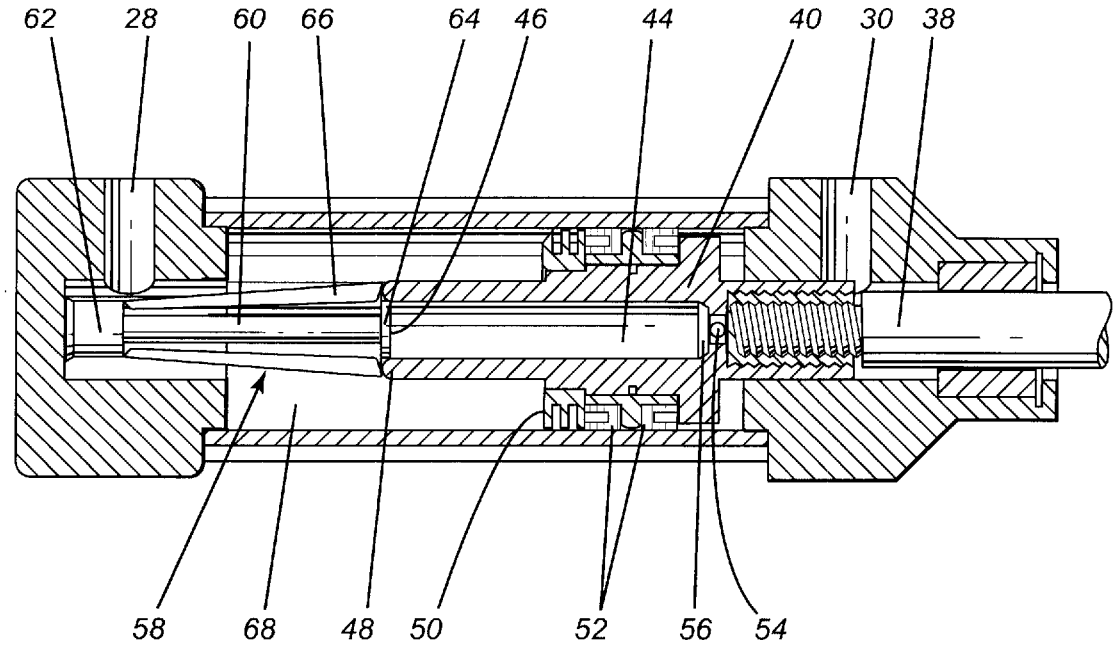
FIG. 3 is a cross sectional view of the autonomous gas powered ram of FIG. 1 wherein the actuator is illustrated in the second operative mode.

With reference to FIGS. 1 to 3, an autonomous gas powered ram constructed in accordance with the first embodiment of the invention is identified by the reference numeral 10.

Autonomous gas powered ram 10 can be incorporated to any component such as an elevator, a crane, a lift, a door, a gate, wheels, gears or breaking devices for stopping the movement of a component upon detection of an operation failure, a fire or a hazardous operation condition.

For example, autonomous gas powered ram 10 can stop movement of an elevator, a gate or a lift upon detection of a rupture of a cable, it can block a doors of a building in its open position upon detection of a fire in order to permit evacuation of the persons situated in the building through this door, it can stop movement of a seat upon detection of a vehicle collision, it can stop movement of a vehicle upon detection of a failure of its breaking system or it can block a door of a building or an armored truck in its close position upon detection of the presence of a thief therein.

Autonomous gas powered ram 10 comprises a main body 12 having an internal cavity 14. Main body 12 can be made of a variety of different materials and can be of a variety of different shapes. Autonomous gas powered ram 10 also comprises first and second end portions 16 and 18 closing said main body 12 at its ends. First end portion 16 comprises a chamber 20 having peripheral wall 22 and an abutting wall 24. Second end portion 18 comprises a passageway 26 communicating with the exterior of main body 12. Ram 10 may also comprise fluid-pathway openings 28 and 30 for admitting pressurized working fluid within main body 12.

Ram 10 further comprises an actuator 38 connected to a piston 40. Actuator 38 is connected to piston 40 with a ring 42 that electrically isolated actuator 38 from piston 40. Piston 40 is therefore incapable of conducting any electricity that may be present in actuator 38.

Piston 40 comprises an internal wall surrounding a detonation chamber 44 having an orifice 46 at an end portion 48. Piston 40 also comprises an electrically conducting member 50 and sealing rings 52 mounted around piston 40. Member 50 is made of an electrically conductive material capable of conducting a weak current (+/−25 mV for example). Sealing rings 52 are made of a synthetic material for maintaining a sealing engagement with the peripheral wall of internal cavity 14.

Autonomous gas powered ram 10 also comprises a detonator 54 and an explosive charge 56 connected to detonator 54. The explosive charge 56 is located within detonation chamber 44. Detonator 54 is chemically sensitive and/or electro-sensitive in order to trigger explosive charge 56 upon detection of a chemical reaction or an electric current. Ram 10 also comprises an electric impulse pathway leading from explosive charge to the exterior of main body 12. It is also understood that detonator 54 may trigger explosive charge 56 upon detection of a physical changes such as a pressure variation. Different suitable detonators are well known for the person skilled in the art and no further description is required concerning the various possibilities for triggering explosive charge 56.

Upon detonation of explosive charge 56, movement of piston 40 causes displacement of actuator 38 from a first operative mode to a second operative mode. In the first operative mode, actuator 38 is in a first position relative to main body 12 while, in the second operative mode, actuator 38 is in a second position relative to main body 12. The first position of actuator 38 is different from its second position.

Autonomous gas powered ram 10 further comprises a second piston 58 having a stem 60 with an abutting member 62 at one end and a disc 64 at the other end. Second piston 58 is slidingly mounted within detonation chamber 44. In fact, the diameter of disc 64 is slightly smaller than the one of detonation chamber 44 in order to allow displacement of second piston 58 relative to detonation chamber 44. Second piston 58 also comprises latch members in the form of fins 66 attached at one of their ends to abutting member 62. Second piston 58 with latch members constitutes a lock that prevents actuator 38 from moving to the first operative mode when explosive charge 56 has detonated, second piston 58 and actuator 38 being moveable along parallel axes. In fact, piston 40 is moveable in internal cavity 14 along a first path of travel while second piston 58 and detonation chamber 44 are moveable along a second path of travel, the first and second paths of travel being parallel and coaxial.

In FIG. 1, autonomous gas powered ram 10 is illustrated with actuator 38 being in the first operative mode wherein it is entirely confined within main body 12. In operation, when an operation failure, a fire or a hazardous operation condition is detected wherein it is required that actuator 38 being actuated by an autonomous source, explosive charge 56 detonates and generates a quantity of gas injected into detonation chamber 44. To this effect, detonator 54 may be connected to a sensor, and when an operation failure is detected, an electric current is supplied to detonator 54. A chemical or physical reaction producing the same effect is also within the scope of the invention. The gas then expands within detonation chamber 44 and pistons 40 and 58 move relative to each other in response to generation of the gas. Movement of piston 40 causes displacement of actuator 38 towards the second operative mode (see FIG. 2).

It is understood that as soon as explosive charge 56 is triggered and the gas is generated into detonation chamber 44, abutting member 62 abuts against abutting wall 24 and the gas pressure is applied afterwards on disc 64 thereby moving piston 40 relative to second piston 58.

Detonation chamber 44 has a diameter that slightly increases towards orifice 46 to define a gap between disc 64 and the peripheral wall of detonation chamber 44 that progressively widens as second piston 58 projects from detonation chamber 44, this gap allowing gas generated by the detonation of explosive charge to escape from detonation chamber 44. In that sense, once explosive charge has detonated, detonation chamber 44 communicates with an expansion chamber 68 in order to allow gradual dissipation of pressure and heat. This leakage of gas is thus intended for avoiding an increase of temperature and/or pressure within detonation chamber 44 that can damage the various components of the autonomous gas powered ram of the invention. The volume of expansion chamber 68 may be five to fifteen times larger to the one of detonation chamber 44 in order to dissipate the heat and pressure generated in this detonation chamber.

As actuator 38 moves towards the second operative mode, fins 66 are withdrawn from detonation chamber 44, and once they are entirely located outside this chamber, fins 66 then deploy and project transversally due to their resiliency. Once fins 66 have been entirely deployed, they no longer fit within detonation chamber 44 and instead engage end portion 48 of piston 40 thereby preventing actuator 38 from moving to the first operative mode.

Fins 66 mounted on second piston 58 thus constitute a lock that prevents actuator 38 from moving to first operative mode once it has moved into the second operative mode. This lock is moveable along a first path of travel and actuator 38 connected to first piston 40 is moveable along a second path of travel, the first and the second paths of travel being parallel.

Figure 4:
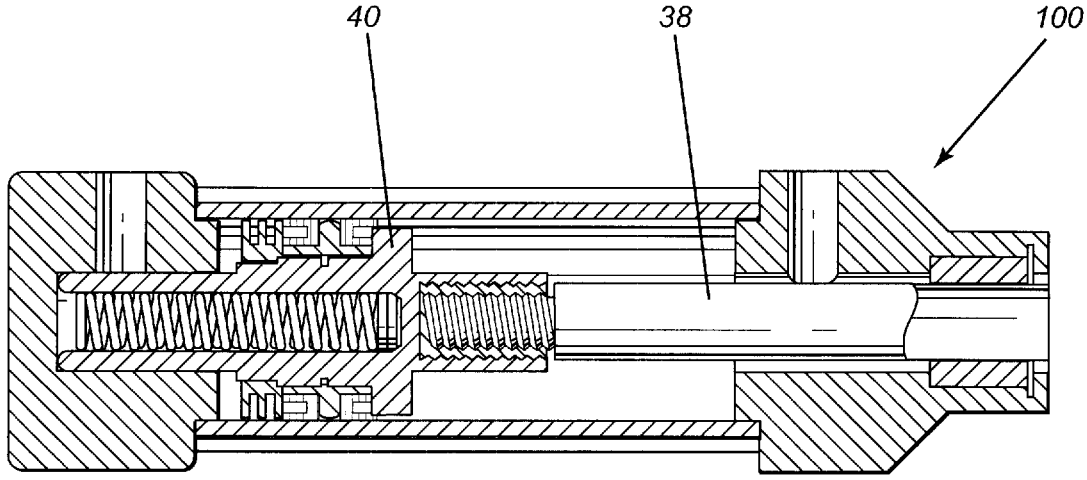
FIG. 4 is a cross sectional view of an autonomous gas powered ram constructed in accordance with a second embodiment.

Should the gas injected into detonation chamber 44 is eventually completely escape, then fins 66 still prevent actuator 38 from moving back towards the first operative mode. As seen in FIG. 4, actuator 38 projects from main body 12 in the second operative mode.

If ram 10 includes fluid-pathway openings 28 and 30 for admitting pressurized working fluid acting on piston 40, piston 40 is coupled to actuator 38 in a driving relationship whereby movement of piston 40 causes displacement of actuator 38 with relation to main body 12. Moreover, the displacement of actuator 38 resulting from detonation of explosive charge 56 is independent from displacement of actuator 38 resulting from movement of piston 40 due to pressurized working fluid.

Second and third embodiments are illustrated in FIGS. 4 to 7. Since these embodiments are similar to the first embodiment, the components used in common to the embodiments are identified by the same reference numerals, and a description of such components will be omitted herein.

Figure 5:
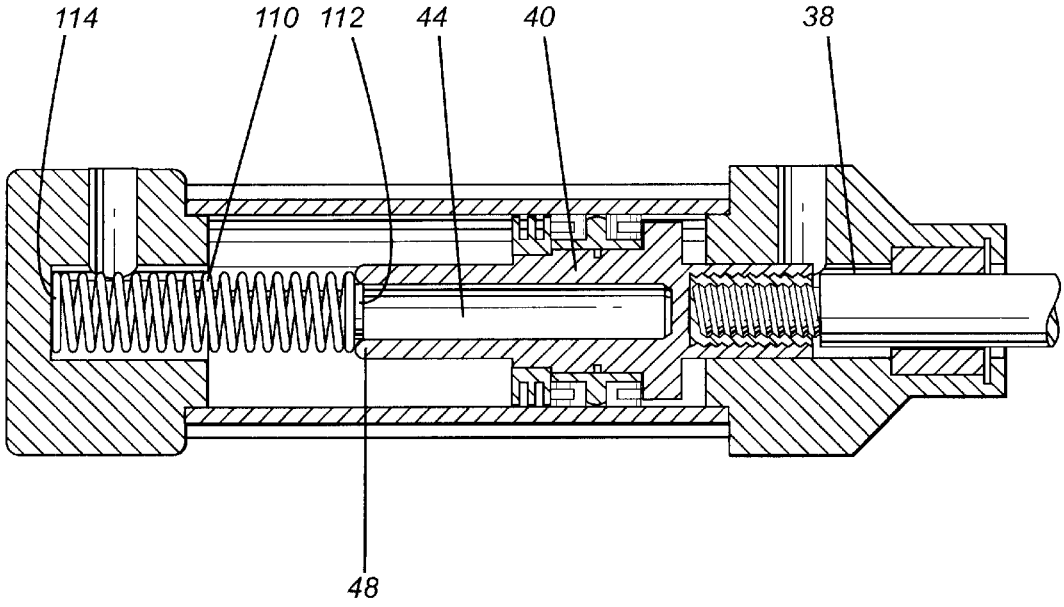
FIG. 5 is a cross sectional view of the autonomous gas powered ram of FIG. 4 wherein the actuator is illustrated in the second operative mode.

In FIGS. 4 and 5, autonomous gas powered ram 100 comprises a spring 110 having a disc 112 at one end and an abutting portion 114 at the other end. In FIG. 4, autonomous gas powered ram 100 is illustrated with actuator 38 being in the first operative mode wherein it is entirely confined within main body 12.

In operation, when an operation failure is detected, actuator 38 is displaced due to the gas pressure created within detonation chamber 44. As actuator 38 moves towards the second operative mode, spring 110 is withdrawn from detonation chamber 44, and once it is entirely located outside this chamber, spring 110 no longer fit within detonation chamber 44 since it is not compressed anymore. Spring 110 thus engages end portion 48 of piston 40 thereby preventing actuator 38 from moving to first operative mode (see FIG. 5). Spring 110 thus constitutes a lock moveable along a first path of travel while actuator 38 connected to first piston 40 is moveable along a second path of travel, the first and the second paths of travel being parallel.

Figure 6:
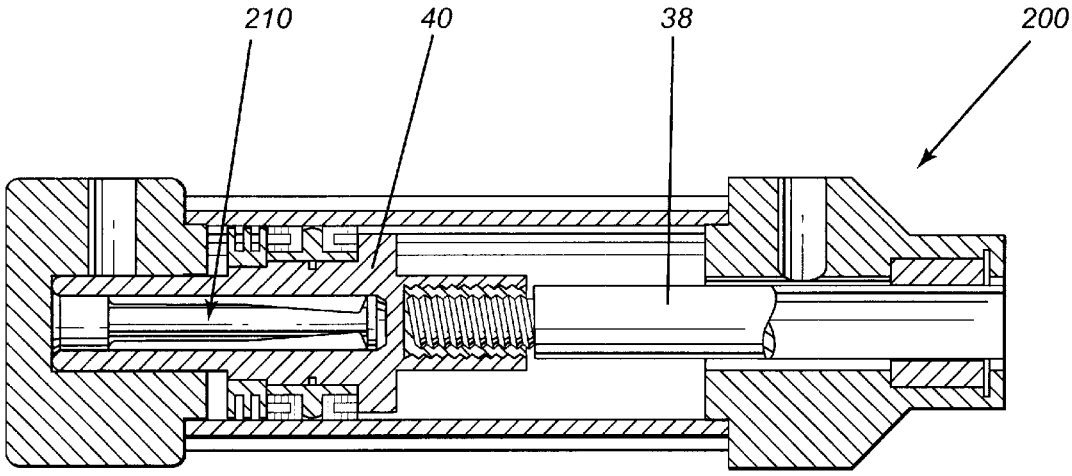
FIG. 6 is a cross sectional view of an autonomous gas powered ram constructed in accordance with a third embodiment.
Figure 7:
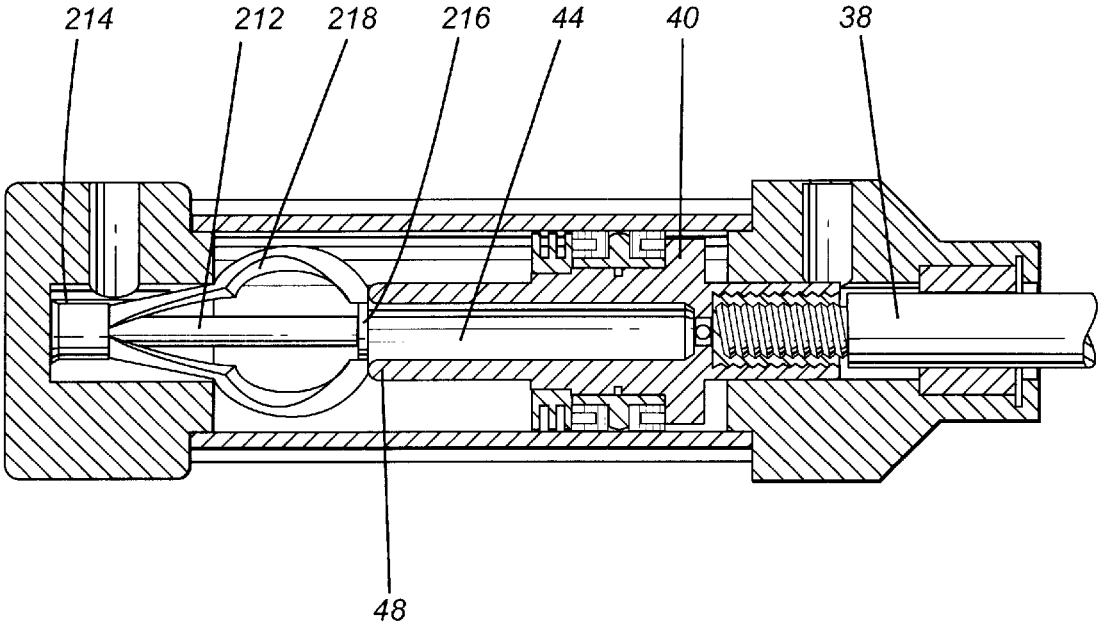
FIG. 7 is a cross sectional view of the autonomous gas powered ram of FIG. 6 wherein the actuator is illustrated in the second operative mode.

In FIGS. 6 and 7, autonomous gas powered ram 200 comprises a second piston 210. In FIG. 6, autonomous gas powered ram 200 is illustrated with actuator 38 being in first operative mode.

Second piston 210 comprises a stem 212 having an abutting portion 214 at one end and a disc 216 at the other end. Second piston 210 further comprises bendable fins 218 affixed at one end to abutting portion 214 and to disc 216 at the other end.

In operation, when an operation failure is detected, actuator 38 is displaced due to the gas pressure created within detonation chamber 44. As actuator 38 moves towards the second operative mode, bendable fins 218 are withdrawn from detonation chamber 44, and once they are entirely located outside this chamber, they do no longer fit within detonation chamber 44 since they are deformed upon movement of actuator 38 towards the first operative mode. Bendable fins 218 thus engage end portion 48 of piston 40 thereby preventing actuator 38 from further moving towards the first operative mode (see FIG. 7). It is understood that the size and material of bendable fins 218 is selected in order to allow the specific amount of deformation necessary to prevent actuator 38 from moving to the first operative mode. Bendable fins 218 mounted on second piston 210 thus constitute a lock that prevents actuator 38 from moving to first operative mode once it has moved into the second operative mode. This lock is moveable along a first path of travel and actuator 38 connected to first piston 40 is moveable along a second path of travel, the first and the second paths of travel being parallel.

Figure 8:
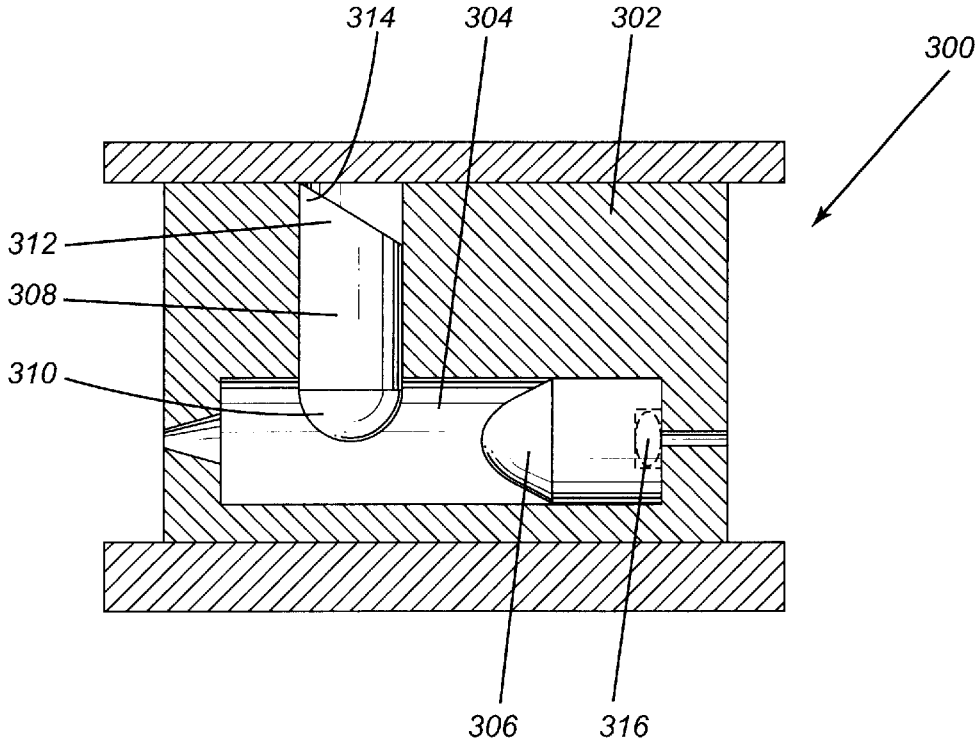
FIG. 8 is a cross sectional view of an autonomous gas powered ram constructed in accordance with a fourth embodiment comprising an actuator having a portion comprising a pointed piercing end.
Figure 9:
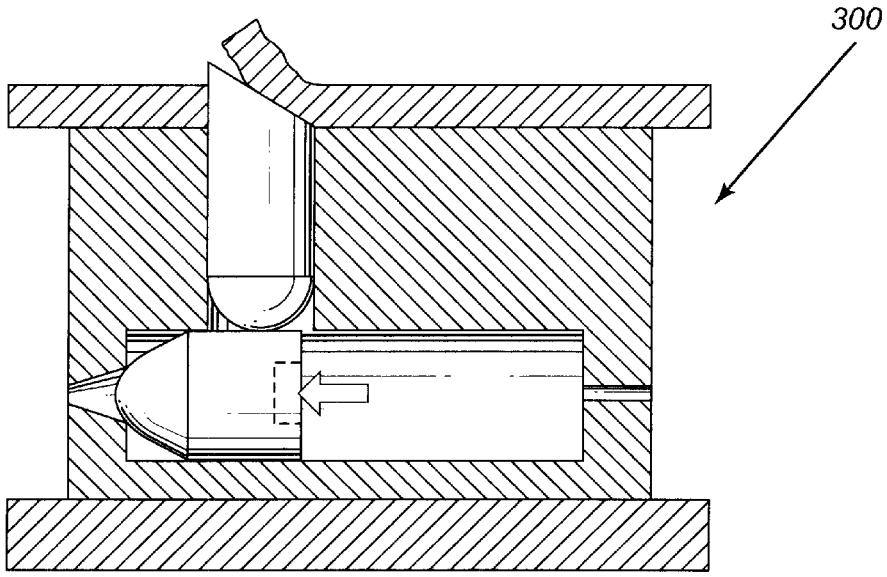
FIG. 9 is a cross sectional view of the autonomous gas powered ram of FIG. 8 wherein the actuator is illustrated in the second operative mode.

With reference to FIGS. 8 and 9, an autonomous gas powered ram constructed in accordance with a fourth embodiment is identified by the reference numeral 300. Autonomous gas powered ram 300 comprises a main body 302 having an internal cavity 304. Autonomous gas powered ram 300 also comprises a lock 306 and an actuator 308 having first and second portions 310 and 312. Second portion 312 comprises a pointed piercing end 314 capable of piercing a wall of a component during the movement of actuator 308. Autonomous gas powered ram 300 also comprises an explosive charge 316 located within internal cavity 304.

In operation, when an operation failure, a fire or a hazardous operation condition is detected wherein it is required that actuator 308 being actuated by an autonomous source, explosive charge 316 detonates and generates a quantity of gas injected into internal cavity 304. To this effect, explosive charge 316 may be connected to a sensor, and when an operation failure is detected, an electric current is supplied to explosive charge 316. A chemical or physical reaction producing the same effect is also within the scope of the invention.

The gas expands within internal cavity 304 and lock 306 is pushed in response to generation of the gas and actuator 308 is therefore displaced by engagement of lock 306 with first portion 310. In fact, first portion 310 of actuator 308 and lock 306 comprise cooperating came surfaces such that displacement of lock 306 along a horizontal path of travel causes the displacement of actuator 308 along a perpendicular path of travel. Lock 306 is thus moveable along a first path of travel while actuator 308 is moveable along a second path of travel, these paths of travel being perpendicular.

Actuator 308 is therefore displaced towards a second operative mode wherein second portion 312 projects from main body 302 and pointed piercing end 314 may engage another component. In the second operative mode, lock 306 engages first portion 310 for preventing actuator 308 from moving to its initial position (see FIG. 9).

Figure 10:
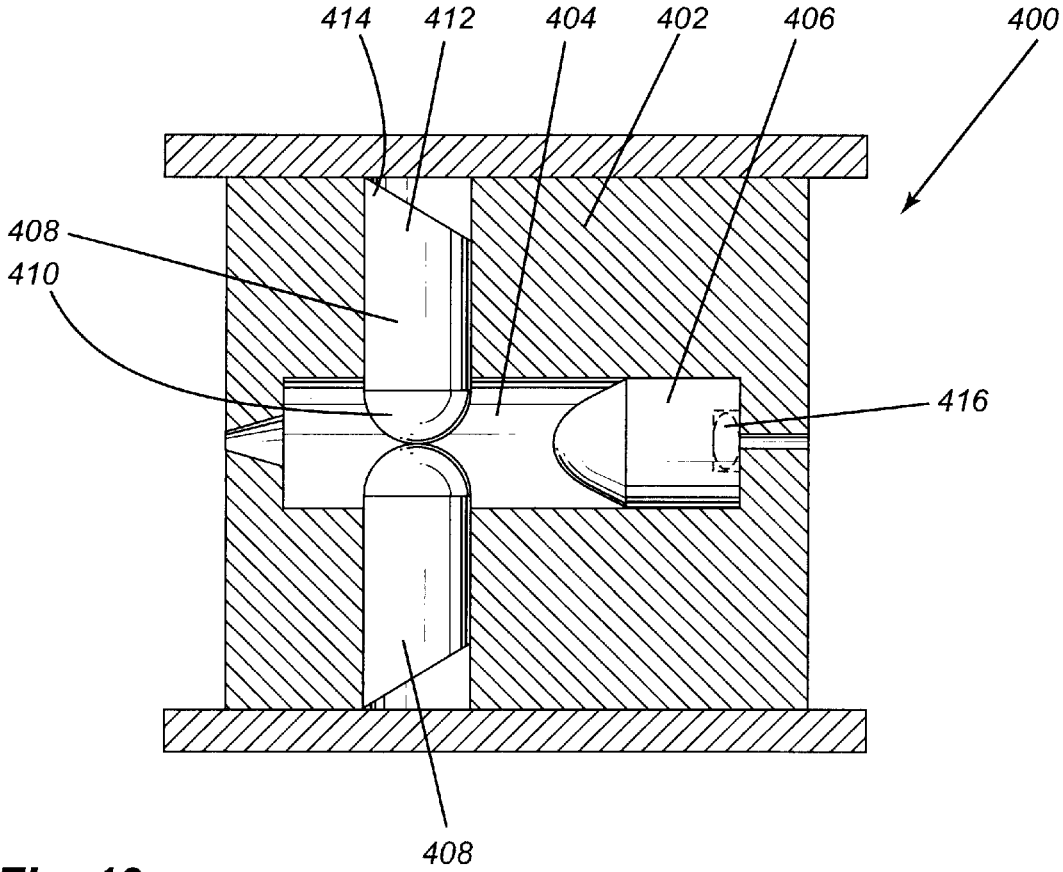
FIG. 10 is a cross sectional view of an autonomous gas powered ram constructed in accordance with a firth embodiment comprising actuators having a portion comprising a pointed piercing end.
Figure 11:
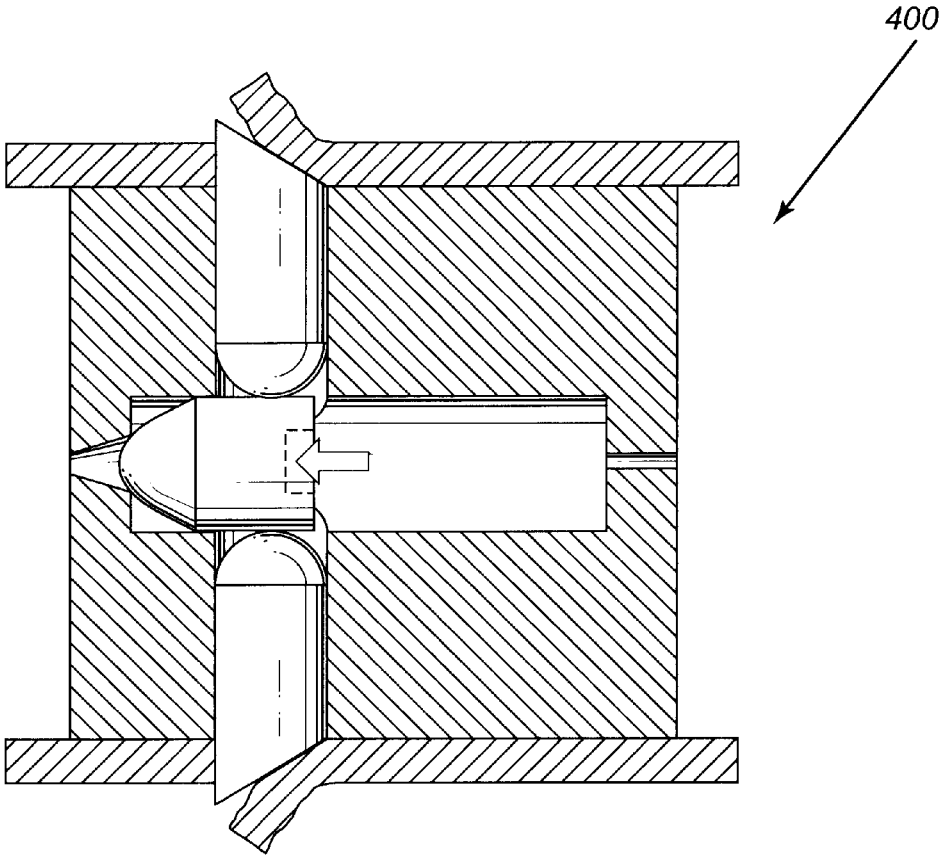
FIG. 11 is a cross sectional view of the autonomous gas powered ram of FIG. 10 wherein actuators are illustrated in the second operative mode.

With reference to FIGS. 10 and 11, an autonomous gas powered ram constructed in accordance with a fifth embodiment is identified by the reference numeral 400. Autonomous gas powered ram 400 comprises a main body 402 having an internal cavity 404. Autonomous gas powered ram 400 also comprises a lock 406 and actuators 408. Each actuator 408 comprises first and second portions 410 and 412. Second portion 412 comprises a pointed piercing end 414 capable of piercing a wall of a component during the movement of actuator 408. Furthermore, autonomous gas powered ram 400 comprises an explosive charge 416 located within internal cavity 404.

In operation, when an operation failure, explosive charge 416 generates a quantity of gas injected into internal cavity 404. The gas expands within internal cavity 404 and lock 406 is pushed in response to generation of the gas and actuators 408 are therefore displaced by engagement of lock 406 with first portions 410. In fact, first portion 410 of actuator 408 and lock 306 comprise cooperating came surfaces such that displacement of lock 406 along a horizontal path of travel causes the displacement of actuators 308 along a perpendicular path of travel. Lock 406 is thus moveable along a first path of travel while actuators 408 is moveable along a second path of travel, these paths of travel being perpendicular.

Actuators 408 are therefore displaced towards a second operative mode wherein second portions 412 project from main body 402 and pointed piercing ends 414 may engage another component. In the second operative mode, lock 406 engages first portions 410 for preventing actuators 408 from moving to their initial position (see FIG. 11).

Autonomous gas powered ram 300 or 400 can be incorporated to any mechanical systems for stopping movement of the system. For example, autonomous gas powered ram 300 or 400 can be incorporated within the wheels of a vehicle for stopping the movement of the vehicle.

From the above, it is understood that the autonomous gas powered ram of the invention is actuated by an explosive charge that generates gas and its operation is therefore not dependent upon a source of power such as electrically, hydraulically or pneumatically powered sources. In that sense, even if the source of power is shut down due to a mechanical, electrical or other type of failure, autonomous gas powered ram will nevertheless operate in order to displace the actuator towards the second operative mode.

Similarly, for a ram comprising a fluid-pathway opening for admitting pressurized working fluid, if the source of power which provides pressurized working fluid to the ram is shut down due to a mechanical or electrical failure, or a leakage of the pressurized working fluid, the ram will nevertheless operate in order to displace the actuator towards the second operative mode.

It is understood that in the second operative mode, the actuator may project from the main body of the ram at its utmost distant position relative to the main body or it may retract within the main body at its utmost internal position relative to the main body. It is also understood that the movement imparted to the actuator due to the detonation of the explosive charge can be a movement of rotation, or translation, wherein the actuator is displaced between to different positions relative to the main body of the ram.

Furthermore, in order to stop the movement of components having different weights and speed, it is understood that more than one autonomous gas powered ram can be used and/or autonomous gas powered ram can be sized in function of the weight and maximum speed of a specific component. Hence, autonomous gas powered ram can comprise parts that are designed in order to withstand a maximum specific pressure and temperature. Furthermore, autonomous gas powered ram may be designed in order to comprise an explosive charge that will generate a pressure and move the actuator with a predetermined strength.

The above description of preferred embodiments should not be interpreted in a limiting manner since other variations, modifications and refinements are possible within the spirit and scope of the present invention. The scope of the invention is defined in the appended claims and their equivalents.

I claim:

1. A ram, comprising:

(a) a main body comprising an internal cavity;

(b) a first piston slidingly mounted in said internal cavity and capable of movement therein;

(c) a second piston at least partially mounted in said first piston;

(d) an actuator mounted in said main body, said first piston being coupled to said actuator in a driving relationship, whereby movement of said first piston in said internal cavity causes displacement of said actuator with relation to said main body;

(e) a fluid-pathway opening in said internal cavity for admitting pressurized working fluid to act on said first piston to move said first piston and displace said actuator; and (f) an explosive charge located within said ram, said explosive charge being adapted to detonate in response to application of an electric impulse thereto, a detonation of said explosive charge causing movement of said second piston thereby displacing said actuator relative to said main body, the displacement of said actuator being independent of the pressurized working fluid.

2. The ram as defined in claim 1 wherein detonation of said charge causes displacement of said actuator from a first operative mode to a second operative mode, in said first operative mode said actuator being in a first position relative to said main body, in said second operative mode said actuator being in a second position relative to said main body, said first position being different than said second position.

3. The ram as defined in claim 2 wherein said ram further comprises a lock in said main body for preventing said actuator from moving to said first operative mode when said explosive charge has detonated.

4. The ram as defined in claim 3 wherein said lock is mounted on said second piston.

5. The ram as defined in claim 4 wherein said ram comprises a detonation chamber in which said explosive charge is located.

6. The ram as defined in claim 5 wherein said ram comprises a gas expansion chamber communicating with said detonation chamber once said actuator moves towards said second operative mode.

7. The ram as defined in claim 6 wherein the volume of said gas expansion chamber is at least equal to the volume of said detonation chamber.

8. The ram as defined in claim 7 wherein said explosive charge detonates in response to application of an electric impulse thereto, said ram further comprising an electric impulse pathway leading from said explosive charge to an exterior of said main body.

9. The ram as defined in claim 8 wherein gases located in said expansion chamber apply pressure on said first piston once said explosive charge has detonated.

10. The ram as defined in claim 9 wherein said first piston comprises a sealing ring engaging an internal wall of said main body.

11. The ram as defined in claim 10 wherein said detonation chamber is located within said first piston.

12. An autonomous gas powered ram, comprising:

(a) a main body comprising an internal cavity;

(b) a first piston capable of movement in said internal cavity;

(c) a second piston at least partially mounted in said first piston;

(d) an actuator mounted in said internal cavity, said actuator being movable in said cavity from a first operative mode to a second operative mode, in said first operative mode said actuator being in a first position relative to said main body, in said second operative mode said actuator being in a second position relative to said main body, said first position being different from said second position, said actuator being connected to said first piston whereby movement of said first piston in said internal cavity causes displacement of said actuator between said operative modes; and (e) an explosive charge in a detonation chamber located within said ram, said explosive charge being adapted to detonate in response of an electric impulse thereto, a detonation of said explosive charge causing movement of said second piston thereby displacing said actuator towards said second operative mode, wherein said internal cavity comprises a gas expansion chamber communicating with said detonation chamber once said actuator moves towards said second operative mode, the volume of said gas expansion chamber being at least equal to the volume of said detonation chamber.

13. The ram as defined in claim 12 wherein said second piston comprises a lock for preventing said actuator from moving to said first operative mode when said explosive charge has detonated.

14. The ram as defined in claim 13 wherein the volume of said gas expansion chamber is at least five times larger than the volume of said detonation chamber.

15. The ram as defined in claim 14 wherein said explosive charge detonates in response to application of an electric impulse thereto, said ram further comprising an electric impulse pathway leading from said explosive charge to an exterior of said main body.

16. The ram as defined in claim 15 wherein gases located in said expansion chamber apply pressure on said first piston once said explosive charge has detonated.

17. The ram as defined in claim 16 wherein said ram further comprises a fluid-pathway opening in said internal cavity for admitting pressurized working fluid to act on said first piston to move said first piston and displace said actuator, the displacement of said actuator being independent of the pressurized working fluid once said explosive charge has detonated.

18. The ram as defined in claim 17 wherein said first piston comprises a sealing ring engaging an internal wall of said main body.

19. The ram as defined in claim 18 wherein said detonation chamber is located within said first piston.

* * * * *